United States Patent [19]

Karube et al.

[11] Patent Number: 4,875,790

[45] Date of Patent: Oct. 24, 1989

[54] PRINTING DEVICE HAVING GEAR CONNECTED MULTIPLE FEED PATHS

[75] Inventors: Yoshiyuki Karube; Toshimasa Hayakawa; Yasunari Yoshida, all of Nagoya, Japan

[73] Assignee: Brother Kogyo Kabushiki Kaisha, Tama, Japan

[21] Appl. No.: 119,054

[22] Filed: Nov. 10, 1987

[30] Foreign Application Priority Data

Nov. 10, 1986 [JP] Japan ..... 61-267079

[51] Int. Cl.[4] ..... B41J 11/48

[52] U.S. Cl. ..... 400/605; 400/568; 400/569; 400/616.2; 400/616.3; 400/703; 400/708

[58] Field of Search ..... 400/600.2, 605, 616, 400/616.1, 616.2, 616.3, 568, 569, 703, 708, 708.1

[56] References Cited

U.S. PATENT DOCUMENTS

| | | | |
|---|---|---|---|
| 4,360,279 | 11/1982 | Sugiura | 400/600.2 |
| 4,386,864 | 6/1983 | Wang et al. | 400/708 X |
| 4,572,418 | 2/1986 | Hirata | 400/569 X |
| 4,606,663 | 8/1986 | Christoph et al. | 400/605 |

FOREIGN PATENT DOCUMENTS

| | | | |
|---|---|---|---|
| 0044379 | 3/1985 | Japan | 400/605 |
| 0049976 | 3/1985 | Japan | 400/605 |
| 0084263 | 4/1986 | Japan | 400/569 |
| 0192576 | 8/1986 | Japan | 400/605 |
| 2076745 | 12/1981 | United Kingdom | 400/569 |

*Primary Examiner*—Ernest T. Wright, Jr.

*Attorney, Agent, or Firm*—Kane, Dalsimer, Sullivan, Kurucz, Levy, Eisele and Richard

[57] ABSTRACT

A printing device wherein a cut-form printing sheet and a serial-form printing sheet is selectively in use is disclosed. The disclosed printing device is characterized by:

first sensing means for detecting the position of an idler gear which selectively transmits a driving force of a platen to a gear coupled to a serial-form paper feeding means;

second sensing means for detecting the presence of the serial-form paper to be fed by the feeding means;

displacement detecting means for detecting the displacement of said idler gear means by monitoring the results of detection of said first sensing means; and control means for controlling a driving means to rotate the platen so as to reposition the idler gear means by a degree substantially corresponding to its tooth width on condition that said displacement detecting means detects the displacement of said idler gear means and that the first and second sensing means detect the presence of the serial-form sheet as well as the idler gear means being in its selected position to transmit the driving force to the gear of the feeding means.

8 Claims, 4 Drawing Sheets

PRINTING DEVICE HAVING GEAR CONNECTED MULTIPLE FEED PATHS

BACKGROUND OF THE INVENTION

This invention relates to a printing device in which an idler gear in mesh with a gear coupled to a platen is displaced to engage with and disengage from a gear coupled to a tractor depending on the use of a cut-form or a serial-form sheet, and more particularly to a printing device of the above mentioned type in which, with the use of a serial-form sheet, an accidental rotational displacement of the gear coupled to the tractor occurring when the idler gear is temporarily disengaged from the tractor gear due to an operational mistake can be corrected.

In prior printing devices in which a cut-form sheet and a serial-form sheet are selectively used, the idler gear is disengaged from the gear on the tractor side to allow the platen only to be rotated when the cut-form sheet is used. If a serial-form sheet is to be used the tractor is engaged by operating a lever to engage the gear on the tractor side.

When, with the serial-form sheet in use, however, the lever is operated by mistake to temporarily disengage the idler gear from the gear on the tractor side, with the gears then being re-engaged to cope with the error, undesirable results will take place as follows.

As illustrated in FIG. 4(*a*), with both gears engaged together, the tooth surface of the idler gear X abuts against that of the gear Y on the tractor side in the paper feed direction indicated by Z, with no backlash in this direction Z. When the idler gear X is displaced to go out of engagement with the gear Y on the tractor side, the idler gear X is slightly rotated in the Z direction as illustrated in FIGS. 4(*b*) through 4(*d*) to press the tooth of the gear Y on the tractor side against the tension of the serial-form sheet. When the idler gear X is disengaged from the gear Y on the tractor side, the gear Y is returned to its initial position by means of the tension of the serial-form sheet. When these are then brought into re-engagement, the idler gear X at its tooth surface presses the tooth surface of the gear Y on the tractor side to angularly displace the gear Y by a degree corresponding to the tooth width in the direction opposite the paper feed direction Z.

Resuming operation with this state retained, the line spacing of the document becomes narrower than set at a place where the misoperation has taken place, resulting in a sloppy looking printed document.

SUMMARY OF THE INVENTION

It is therefore an object of the invention to provide an improved printing device capable of constantly providing a neat-looking printed document without narrowing the line spacing below the set value at a certain section of the document, even if the operation goes on with the idler gear temporarily displaced when the serial-form sheet is in use.

For the above purpose, according to the invention, there is provided a printing device wherein a cut-form printing sheet and a serial-form printing sheet is selectively in use, and which comprises a platen for supporting the selected one of said cut-form printing sheet and said serial-form printing sheet in its printing position;

first gear means coupled to and rotated with said platen;

tractor means for feeding said serial-form printing sheet to its printing position;

second gear means coupled to said tractor means to drive it;

idler gear means displaceable between its first position, where said idler gear means engages said first gear means and disengages from said second gear means, and its second position, where said idler gear means engages both said first and second gear means;

displacing means for displacing said idler gear means between its first and second position; and driving means for rotating said platen;

the improvement which comprises:

first sensing means for detecting the position of said idler gear means;

second sensing means for detecting the presence of said serial-form sheet to be fed by said tractor means;

displacement detecting means for detecting the displacement of said idler gear means by monitoring the results of detection of said first sensing means; and control means for controlling said driving means to rotate said platen so as to reposition said idler gear means by a degree substantially corresponding to its tooth width on condition that said displacement detecting means detects the displacement of said idler gear means and that said first and second sensing means detect the presence of said serial-form sheet as well as said idler gear means being in its second position.

With the printing device as above constructed, when the idler gear means is temporarily disengaged from the second gear means with the serial-form sheet in use, and then is returned to its initial position, the idler gear means is angularly repositioned by a degree corresponding to the tooth width in the paper feed direction by the control means. This allows the printing device to resume the ongoing operation with the feed rate of the serial-form sheet kept normal, without such an undesirable result as reduced line spacings at a certain section.

DESCRIPTION OF THE ACCOMPANYING DRAWINGS

FIGS. 4(*a*) through 4(*f*) are operational diagrams showing engagement and disengagement of a prior art idler gear and pinwheel gear.

DESCRIPTION OF THE PREFERRED EMBODIMENTS

Figure 1:
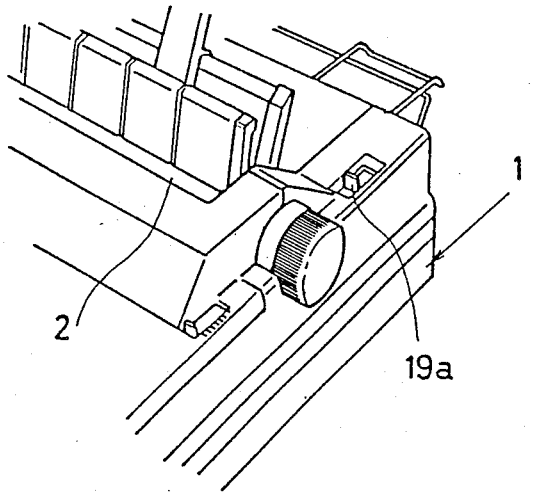
FIG. 1 is a partial perspective view of a main unit of a printing device embodying the invention.
Figure 2:
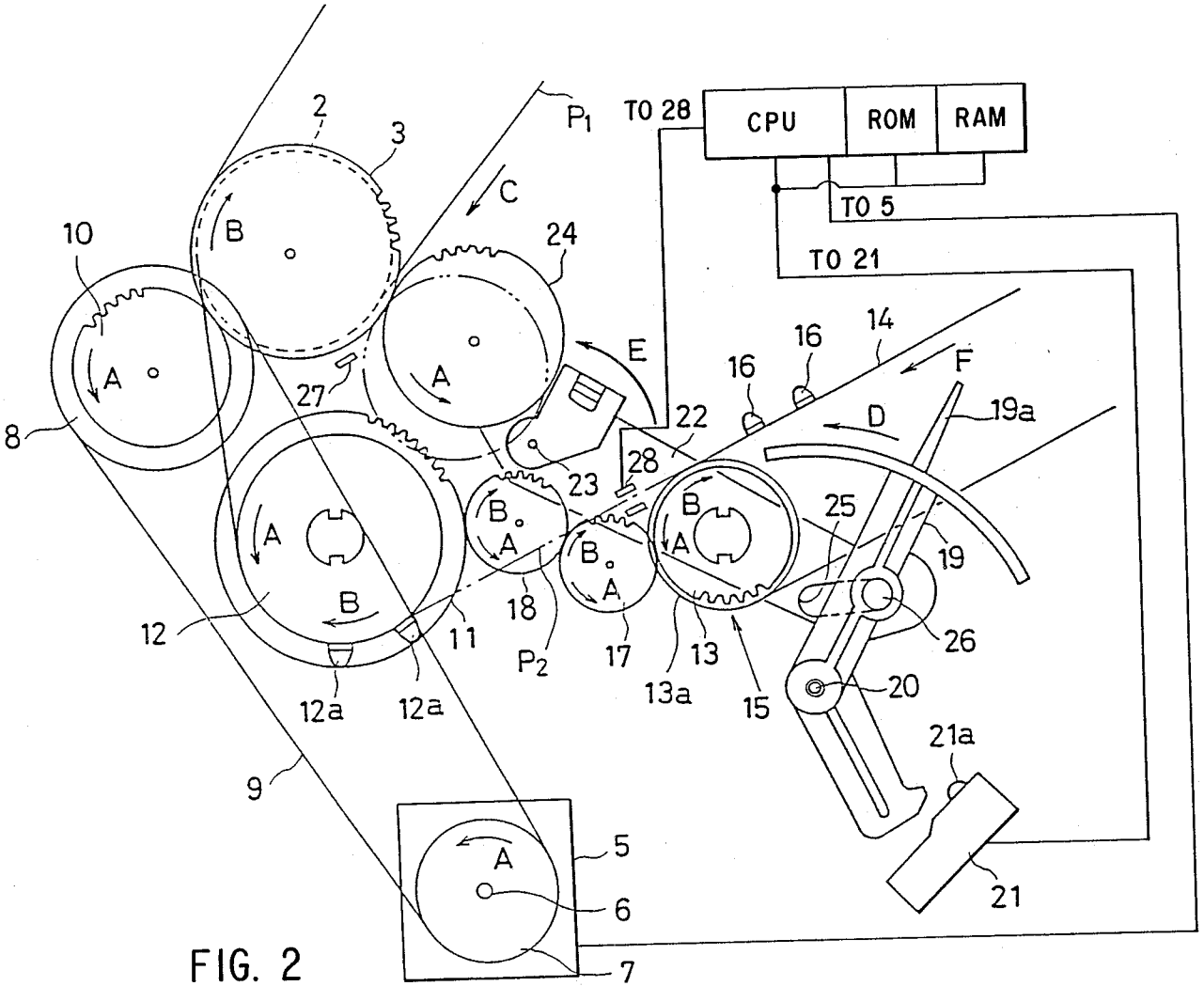
FIG. 2 is a front view showing essential parts of the printing device illustrated in FIG. 1.

FIG. 1 shows a printer main unit 1 embodying the invention, wherein a cylindrical platen 2 is rotatably mounted. Close to the platen 2 is arranged a printing mechanism located leftward of the drawing (through not shown), which is of a known structure consisting of a type wheel mounted on a carriage, hammer, ribbon cassette etc. See for example, U.S. Pat. No. 4,386,864. The platen 2 has a gear 3 coupled to the platen as shown in FIG. 2 (hereinafter referred to as "platen gear"). Under the platen 2 is arranged a paper feed motor 5, with a drive pulley 7 mounted on its motor axis 6. The drive pulley 7 is linked to a follower pulley 8 close to the platen 2 by means of a timing belt 9. The follower pulley 8 concentrically carries a feed gear 10 in mesh with the platen gear 3. Indicated by numeral 11 is a gear coupled to the tractor 15 (hereinafter referred to as "pinwheel gear") located under the platen gear 3, which concentrically carries a pinwheel 12 having equally spaced multiple pins 12*a* on its outer circumference. Rightward of the pinwheel 12 in the drawing is arranged a tractor 15 consisting of a pair of drive pulleys 13*a* (though only one is shown) and a timing belt 14 hung around the drive pulleys 13*a*. The timing belt 14 is provided with multiple pins 16 on its outer circumference as on the pinwheel 12. The drive gear 13 coaxially associated with one drive pulley 13*a* is in mesh with the pinwheel gear 11 by means of first and second pinion gears 17 and 18. Indicated by numeral 19 is a generally V shaped change lever which is pivotally supported on a pivot shaft 20, the upper end of which is projected from the main unit 1 to form a knob 19*a* and the lower end of which faces a microswitch 21. Numeral 22 indicates a swing lever rotatably mounted on a pivot shaft 23, with one end provided with a rotatably supported idler gear 24 and the other end formed with an elongate slot 25, the extending direction of which is tilted toward the rotational direction of the lever 19. The swing lever 22 is displaceable between its first position in which the idler gear 24 is separated from the pinwheel gear 11 and engages with the platen gear 3 and its second position in which the idler gear 24 is in mesh with the pinwheel gear 11 while engaging also the platen gear 3. A pin 26 secured to the lever 19 is longitudinally slidably inserted into the elongate slot 25. In the state shown in FIG. 2, the pin 26 of the lever 19 abuts against the right end of the slot 25 as shown to hold the idler gear 24 in the first position. In this state, also, the presser 21a of the microswitch 21 is relieved of a pressure from the lower end of the lever 19 keeping the microswitch 21 off.

The operation of the whole printing device including paper feed is controlled by a CPU (central processing unit) in accordance with an operation program stored in a ROM (read-only-memory) and command code stored in a RAM (random-access-memory).

The printing device as above constructed operates as follows.

When using a cut-form sheet P1, the cut-form sheet P1 is inserted between the platen 2 and a friction roller, not shown. With a paper feed switch not shown then closed, the CPU runs the program for feeding cut-form sheet P1 in response to the off position of the microswitch 21 thus energizing the feed motor 5. This causes a rotation of the drive pulley 7 in the "A" direction, which is transmitted to the platen gear 3 and therefore the platen 2 via the belt 9, the follower pulley 8 and the feed gear 10 in this sequence. The platen 2 is then rotated in the direction indicated by an arrow "B" to move the cut-form sheet P1 in the feed direction of "C". The sensor 27 senses the leading end of the cut-form sheet P1 to keep the motor 5 energized so that the cut-form sheet P1 is moved in the feed direction by a certain amount to be installed at a printing position on the platen 2. Thereafter, the printing device performs a desired printing operation on the platen 2.

When using a serial-form sheet P2, the cut-form sheet P1 is removed from the platen 2 and the lever 19 is turned in the direction of an arrow "D" by way of the knob 19*a*. This causes the pin 26 to be moved along the elongate slot 25 to its left end so that the swing lever 22 is rotated in the direction of an arrow "E" around the pivot shaft 23. The lower end of the swing lever 22 thus presses the presser 21*a* to turn on the microswitch 21, while the idler gear 24 is displaced as indicated by a double-dotted line in FIG. 2 from its first to second position to be brought into mesh with both the platen gear 3 and the pinwheel gear 11. The serial-form sheet P2 is then set on the tractor 15 with the pins 16 fit into the perforations of the serial-form sheet P2. With the paper feed switch, not shown, then closed, the CPU runs the program for feeding serial-form sheet P2 in response to the on-position of the microswitch 21 to energize the feed motor 5. This causes a rotation of the drive pulley 7 in the direction of "A", which is transmitted to the platen gear 3 to rotate the idler gear 24 in the direction of the arrow "A" as in using the cut-form sheet P1. This causes the pinwheel gear 11 to rotate in the direction of "B", then rotating the drive gear 13 via the second and first pinions 18 and 17 in the direction of the arrow "A". With this, the timing belt 14 is moved in the direction of "F" to feed the serial-form sheet P2, the leading end of which is sensed by a photoelectric paper sensor 28 disposed between the tractor 15 and the pinwheel 12. In response to this sensor signal, the CPU keeps the feed motor 5 energized for a certain period so that the serial-form sheet P2 guided by the pinwheel 12 is set on the printing position on the platen 2. The printing device then performs a required printing operation for the serial-form sheet P2 as for the cut-form sheet P1.

In such an operation with the serial-form sheet P2, there may be an operational error of turning the lever 19 in the direction to displace the idler gear 24 to its first position, i.e., in the direction opposite the arrow D, the lever 19 being then returned to the original position by the operator who has become aware of the error. In this case, the idler gear 24 is once disengaged from the pinwheel gear 11 and is again brought into engagement therewith. Accordingly, as explained in the prior art description, the idler gear 24 during its re-engagement presses, with its tooth surface, the corresponding tooth surface of the pinwheel gear 11 to turn the pinwheel gear substantially by a degree corresponding to the tooth width in the direction of "A", i.e., in the direction opposite the feed direction.

Figure 3:
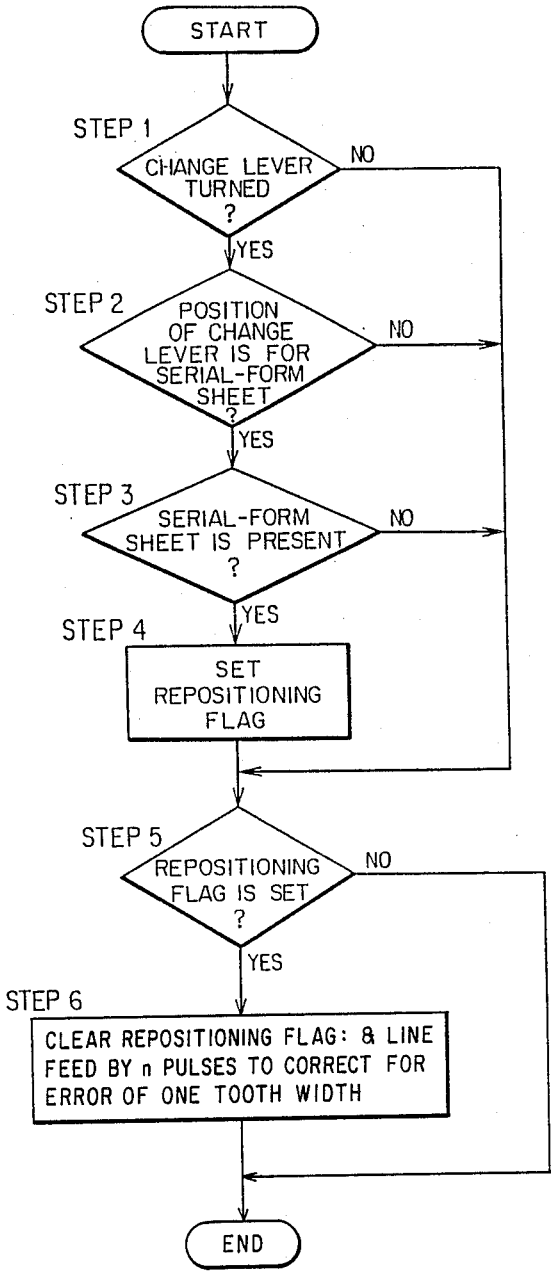
FIG. 3 is a flow chart showing essential steps executed by a control means.
Figure 4A:
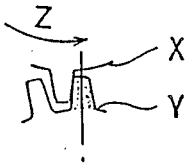
FIG. 4(a) PRIOR ART
Figure 4B:
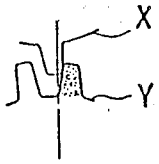
FIG. 4(b) PRIOR ART
Figure 4C:
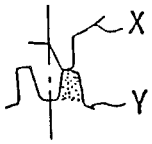
FIG. 4(c) PRIOR ART
Figure 4D:
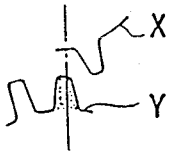
FIG. 4(d) PRIOR ART
Figure 4E:
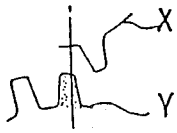
FIG. 4(e) PRIOR ART
Figure 4F:
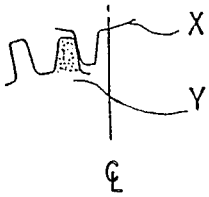
FIG. 4(f) PRIOR ART

When such a mis-operation of the lever 19 takes place with the serial-form sheet P2 in use, repositioning means consisting of the CPU, the ROM and the part of the RAM is operated in response to the on-position of the microswitch 21 so that the pinwheel gear 11 is re-positioned in accordance with the flow chart illustrated in FIG. 3.

Referring now to the flow chart in FIG. 3, in step 1, the turning operation of the lever 19 is detected by a temporary turn-off of the microswitch 21 due to mis-operation of the lever 19. In step 2, it is acknowledged from the on-position of the microswitch 21 that the lever 19 is positioned correctly for the serial-form sheet P2. The paper sensor 28 then confirms the presence of the serial-form sheet P2 in step 3. With the existence of the serial-form sheet P2 acknowledged, a re-positioning flag is set in step 4. Step 5 is to acknowledge setting the re-positioning flag. In step 6, the re-positioning flag is cleared to generate the number of pulses corresponding to the tooth width of the pinwheel gear 11 thereby energizing the feed motor 5. This causes a rotation of the drive pulley 7 in the direction of arrow "A", which is transmitted to the pinwheel gear 11 via the belt 9, the feed gear 10, the platen gear 3 and the idler gear 24. The pinwheel gear 11 is thus angularly displaced by a degree corresponding to the tooth width in the paper feed direction, i.e., in the direction of the arrow "B" to be returned to its correct position.

With the arrangement as described above, when the idler gear 24 is temporarily disengaged from the pinwheel gear 11 due to operational mistake of the lever 19 with the serial-form sheet P2 in use, the pinwheel gear 11 is angularly re-positioned by a degree corresponding to the tooth width in the paper feed direction. This allows the printing device to resume the ongoing operation with the feed rate of the serial-form sheet P2 kept normal, without such undesirable results as reduced line spacings at a certain place, which assures a neat appearance of a printing document all the time.

When there is no serial-form sheet P2 set, that is, when the sensor 28 does not detect the presence of the sheet P2, an attempt of operating the lever 19 as described above to re-engage the idler gear 24 with the pinwheel gear 11 is rejected in step 3 so that no re-positioning operation takes place.

While in the aforementioned embodiment, the motor 5 is energized for re-positioning immediately after the lever 19 is operated, a corresponding feed rate may be added to the paper feed operation after the operation of the lever 19 is completed.

What is claimed is:

1. A printing device having gear connected multiple feed paths wherein a cut-form printing sheet and a serial form printing sheet may be selectively brought into use which comprises a platen for supporting the selected on of said cut-form printing sheet and said serial form printing sheet in its printing position;

first gear means coupled to and rotated with said platen;

tractor means for feeding said serial form printing sheet to its printing position;

second gear means coupled to said tractor means;

idler gear means displaceable in a direction perpendicular to an axial direction of said second gear means between a first position where said idler gear means engages said first gear means and disengages from said second gear means, and a second position, where said idler gear means engages both said first and second gear means;

displacing means for displacing said idler gear means between its first and second positions;

driving means for rotating said platen;

first sensing means for detecting the position of said idler gear means;

second sensing means for detecting the presence of said serial form printing sheet to be fed by said tractor means;

mal-operation detecting means for detecting the inadvertent displacement of said idler gear means by monitoring the results of said first sensing means and second sensing means to determine if said idler gear means has been shifted from said second position to said first position and then back to said second position while said second sensing means detects the presence of a serial form printing sheet; and control means for controlling said driving means to rotate said platen by a predetermined amount sufficient to offset any rotation of the platen caused by the engagement or disengagement of the idler gear means and the second gear means so as to reposition said idler gear means by said predetermined amount upon detection of the inadvertent displacement of said idler gear means.

2. The printing device according to claim 1 wherein said first sensing means comprises a microswitch operated in response to the operation of said displacing means.

3. The printing device according to claim 1 wherein said second sensing means comprises a photoelectric sensor arranged along a feeding path of said serial form sheet.

4. The printing device according to claim 1 wherein said idler gear means is rotatably supported by a first swing lever which is swung by said displacing means.

5. The printing device according to claim 4 wherein said displacing means comprises a second swing lever coupled to said first swing lever of said idler gear means so that the first swing lever is swung upon the swinging movement of the second swing lever.

6. The printing device according to claim 5 wherein said first sensing means comprises a microswitch operated in response to the swinging movement of said second swing lever.

7. The printing device in accordance with claim 1 wherein said predetermined amount corresponds substantially to a tooth width of said idler gear means.

8. The printing device in accordance with claim 1 wherein said control means rotates said platen by said predetermined amount at a time when said serial form sheet is to be fed for printing after said inadvertent displacement is detected.

* * * * *